US006447383B2

(12) United States Patent
Oda et al.

(10) Patent No.: US 6,447,383 B2
(45) Date of Patent: Sep. 10, 2002

(54) SANDING APPARATUS WITH AN IMPROVED VIBRATION INSULATING MECHANISM

(75) Inventors: Zenichi Oda; Kenichi Kawai, both of Gamagoori; Akihito Hara, Aichi-ken; Masahiko Inai, Anjo, all of (JP)

(73) Assignee: Makita Corporation, Aichi-Ken (JP)

( * ) Notice: Subject to any disclaimer, the term of this patent is extended or adjusted under 35 U.S.C. 154(b) by 0 days.

(21) Appl. No.: 09/730,125

(22) Filed: Dec. 5, 2000

(30) Foreign Application Priority Data

Dec. 7, 1999 (JP) ..... 11-347847

(51) Int. Cl.[7] ..... B24B 23/00

(52) U.S. Cl. ..... 451/357; 451/356; 451/449; 451/451; 451/453; 451/488

(58) Field of Search ..... 451/356, 357, 451/449, 451, 453, 488

(56) References Cited

U.S. PATENT DOCUMENTS

| | | | | |
|---|---|---|---|---|
| 253,566 A | | 4/1954 | DEX | |
| 3,336,702 A | | 8/1967 | Enders | 51/170 |
| 6,919,611 | | 5/1969 | DEX | |
| 6,159,084 A | * | 12/2000 | Tiede | 451/357 |
| 6,190,245 B1 | * | 2/2001 | Heidelberger et al. | 451/357 |

FOREIGN PATENT DOCUMENTS

| | | |
|---|---|---|
| JP | 62-174857 | 11/1987 |

* cited by examiner

*Primary Examiner*—Joseph J. Hail, III
*Assistant Examiner*—Shantese McDonald
(74) *Attorney, Agent, or Firm*—Lahive & Cockfield, LLP

(57) ABSTRACT

A finishing orbital sander (1) includes a main body (2) and a base (12) provided below the main body. Provided between the main body and the base are a plurality of foot assemblies (22). Each assembly in turn includes a cylindrical or columnar foot (23) made of aluminum and a pair of rubber O-rings (25) at both ends of the cylindrical foot. Each foot additionally includes reduced diameter sections (24) at both ends, where the O-rings are disposed. The reduced diameter sections (24) are fitted in the O-rings and placed in recessed seats (26) provided in opposing surfaces of the main body (2) and the base (12), thus elastically supporting the aluminum feet (23) in the axial direction thereof. The axial dimension of each reduced diameter section (24) is made no longer than the thickness (i.e., the axial dimension) of the O-ring (25), so that the tip end of the reduced diameter section does not exceed or project from the axial outermost end of the O-ring. The foot assemblies (22) can effectively counteract vibration occurring in the axial direction of the feet (23) and reduce vertical vibration of the base (12) while facilitating a smooth orbital motion of the base.

7 Claims, 1 Drawing Sheet

SANDING APPARATUS WITH AN IMPROVED VIBRATION INSULATING MECHANISM

Figure 1:
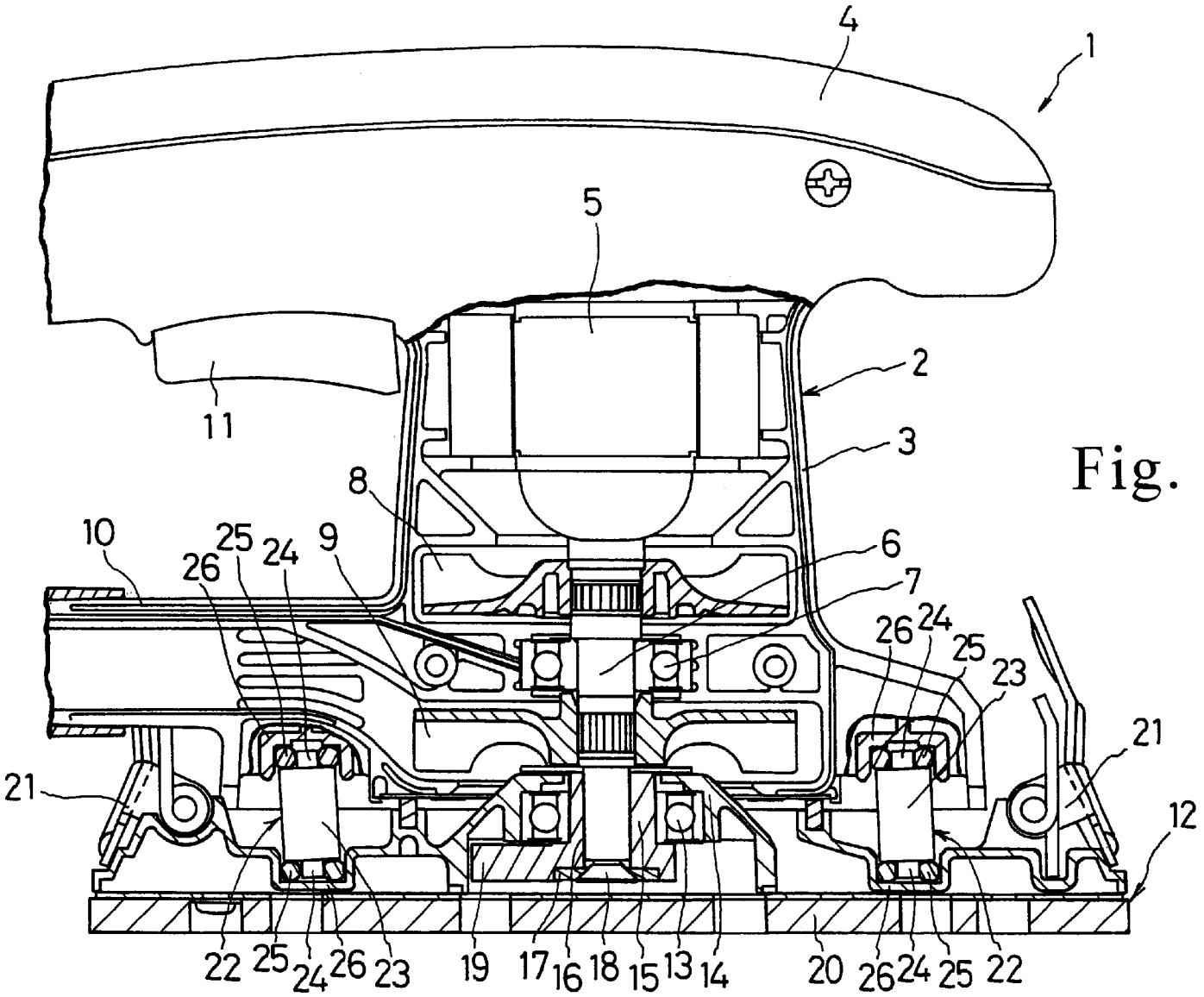

This application claims priority on Japanese Patent Application No. 11-347847 filed on Dec. 7, 1999, the contents of which are incorporated herein by reference.

BACKGROUND OF THE INVENTION

1. Field of the Invention

The present invention relates to sanders. More particularly, the present invention relates to a sander having a main body containing a motor and a base provided below the main body such that the rotation of the motor imparts an orbital motion to the base for sanding work pieces.

2. Description of the Related Art

A typical orbital sander includes a main body containing a motor with an output shaft protruding therefrom in the downward direction. Such a sander additionally includes a base eccentrically coupled to the output shaft such that the rotation of the motor and thus the output shaft imparts an orbital motion (i.e., an eccentric circular motion) to the base, thereby sanding workpiece surfaces when sanding paper is attached to the bottom surface of the base. Typically, such a sander also includes a plurality of feet disposed between the main body and the base for regulating the rotation of the base and for insulating vibration of the base, in particular vertical vibration that is cased by the orbital motion of the base. The majority of such vibration-insulating feet are made of one-piece or integral elastic bodies. Japanese Published Unexamined Utility Model Application No. 62-17857, however, discloses an orbital sander employing composite elastic feet. Each of these feet includes a main central cylinder or column made of a relatively hard elastic material and two other end cylinders made of an elastic material having lesser hardness, each affixed on each end of the main cylinder in order to provide an enhanced vibration insulating effect.

While this foot achieves its intended objective, it is not free from certain problems and inconveniences, thus leaving room for further improvement. As the above-described foot is made of elastic materials, its physical properties are subject to degradation due to heat buildup that occurs during the operation of the sander regardless of whether the foot is made of a combination of hard and less hard elastic materials. Such deterioration often results in a decrease in the vibration insulating effect and/or durability. In addition, the orbital motion of the base causes precession of the feet. The precession not only exerts a shear force and a bending stress on both ends of each foot (which are fixedly supported in the foot seats in the main body and the base), but it also causes wearing down of the foot, thus shortening the service life of the elastic feet.

SUMMARY OF THE INVENTION

In view of the above-identified problems, it is an important object of the present invention to provide a sander having effective vibration insulators of high durability to withstand heat and wear.

It is another object of the present invention to provide a sander with effective and low-cost vibration insulators.

Yet another object of the present invention is to provide a sander with vibration insulators that facilitate dissipation of heat generated during operation thereof.

The above objects and other related objects are realized by the invention, which provides a sander comprising a main body containing a motor and a base provided below the main body. The based is driven by the motor to perform an orbital motion. The sander further comprises a plurality of foot seats provided in the main body and the base and at least one foot assembly disposed between the main body and the base. Each of the at least one foot assembly includes a metal foot having upper and lower end portions and an axis. Additionally, each of the at least one foot assembly further includes elastic bodies adapted to support the end portions in the foot seats in the axial direction of the foot. According to the sander, the at least one foot assembly can effectively counteract vibration occurring in the axial directions of the feet and reduce vertical vibration of the base while facilitating a smooth orbital motion of the base. The arrangement also reduces the effects of heat generated by the operation of the sander as well as wear of the elastic bodies, thus enhancing the durability of the at least one foot assembly.

According to one aspect of the present invention, the sander has four foot assemblies, with each foot including reduced diameter sections provided at the upper and lower end portions thereof. In addition, the elastic bodies include O-rings fitted around the reduced diameter sections in the foot seats. Advantageously, the O-rings provide desired elasticity at a relatively low cost, thus reducing the overall manufacturing cost of the sander.

According to another aspect of the present invention, each O-ring has a circular cross-section, whereas each foot has a cylindrical shape and each reduced diameter section also has a cylindrical shape which has a smaller diameter than the diameter of the remainder of the foot and which is coaxially formed on one of the upper and lower end portions of the foot.

According to still another aspect of the present invention, each O-ring has a greater axial dimension than that of each reduced diameter section, such that a free end of each reduced diameter section does not exceed or project from an outermost end of the O-ring.

According to yet another aspect of the present invention, each foot is made of aluminum. A foot or feet made of aluminum are advantageous due its lightness, hardness, and heat radiation.

According to one feature of the present invention, each foot seat includes a recess sized and dimensioned so as to snugly accommodate an O-ring and a reduced diameter section.

According to another feature of the present invention, each O-ring is coaxially fitted around the reduced diameter portion in the foot seat, such that, when the sander is in use, the O-rings are subjected to compression but not to either shearing or bending.

Other general and more specific objects of the invention will in part be obvious and will in part be evident from the drawings and descriptions which follow.

BRIEF DESCRIPTION OF THE ATTACHED DRAWING

For a fuller understanding of the nature and objects of the present invention, reference should be made to the following detailed description and the accompanying drawing, in which:

FIG. 1 is a cross-sectional view of a finishing sander 1 in accordance with the present invention.

DETAILED DESCRIPTION OF THE PREFERRED EMBODIMENT

A preferred embodiment according to the present invention will be described hereinafter with reference to the attached drawings.

FIG. 1 is a cross-sectional view of a finishing sander 1 in accordance with the present invention. The finishing sander 1 includes a main body 2 and a base 12 disposed below the main body. The main body 2 in turn includes a pair of vertically split casing halves 3 and 4 which contain an inverted motor 5 with its output shaft 6 supported by a ball bearing 7. The output shaft 6 of the motor 5 protrudes downwardly from the bottom of the main body 2 into the base 12. A cooling fan 8 is fitted on the output shaft 6 above the ball bearing 7 for supplying cooling air to the motor 5, and a dust-collecting fan 9 is also fitted on the output shaft 6 below the ball bearing 7 for drawing in particulate dust and other debris from below the main body 2 and sending such debris to a dust-collecting nozzle 10 provided on the left side (as shown in the single FIGURE) of the main body 2. The main body 2 additionally includes a trigger switch 11 for activating the finishing sander 1 when it is pulled in.

The base 12 includes a bearing box 14 directly below the motor 5 for accommodating a ball bearing 13. The base 12 additionally includes an eccentric sleeve 15 that is fitted in the bearing box 14. The eccentric sleeve 15 has an eccentric through-hole 16 formed therein which is penetrated by the output shaft 6 of the motor 5, thus eccentrically supporting the shaft 6. A countersunk screw 17 is tightened in the bottom end of the output shaft 6 via the flat washer 18 in order to prevent the eccentric sleeve 15 from slipping off the output shaft 6. The eccentric sleeve 15 additionally includes a balancer 19 protruding to the eccentric side of the sleeve 15. The base 12 further includes a pad 20 on the bottom surface thereof. Provided on opposite edges of the upper surface of the base 12 is a pair of clamps 21 for fixing on the base 12 sanding paper that is stretched across the pad 20.

The finishing sander 1 further includes a plurality of, such as four, foot assemblies 22 disposed between the main body 2 and the base 12. Each foot assembly 22 comprises a cylindrical or columnar foot 23 made of aluminum and a pair of rubber O-rings 25 at both ends of the cylindrical foot 23. Furthermore, as illustrated, each foot 23 includes reduced diameter sections 24 coaxially provided at both ends thereof, where the O-rings 25 are disposed. To interpose each of the foot assemblies 22 between the main body 2 and the base 12, the reduced diameter sections 24 of the foot 23 are fitted in the O-rings 25 and seated in recessed seats 26 provided in opposing surfaces of the main body 2 and the base 12. This arrangement provides a pilot pressure to the O-rings 25 such that the O-rings are held under slight compression so as to elastically support the aluminum feet 23 in the axial direction of the feet 23. The axial length of each of the reduced diameter sections 24 is made no longer than the thickness of the O-ring 25, so that the tip end of the section 24 does not exceed or project from the axial outermost end of the ring 25.

In the operation of the finishing sander 1 so constructed, the trigger switch 11 is pushed in to activate the motor 5, thus rotating the output shaft 6. As the lower ball bearing 13 in the base 12 eccentrically supports the output shaft 6 via the eccentric sleeve 15, the rotation of the output shaft 6 imparts an orbital motion (an eccentric circular motion) to the base 15 about the axis of the output shaft 6, thus causing the sanding paper on the bottom surface of the base 12 for sanding a work piece.

Due to the orbital motion of the base 12, each foot assembly 22 undergoes precession, with the lower end of each foot assembly 22 secured in the lower seat 26 performing a circular motion that follows the movement of the base 12 with respect to the upper end secured in the upper seat 26. This precession regulates the movement of the base 12 while lessening the vertical vibration of the base 12. Each foot 23 of the foot assembly 22 is made of aluminum, and thus has a sufficient degree of hardness to effectively dampen the vertical vibration of the base 12 that occurs during the operation of the sander 1. Moreover, the feet 23 advantageously and effectively dissipate heat generated by the operation of the finishing sander 1. Additionally, as the upper and lower ends of each foot 23 are elastically supported by the O-rings 25 in such a manner as to allow relatively free movement of the foot ends, the foot 23 is able to undergo precession smoothly. As an added advantage, the O-rings 25 are subjected to compression only, but not to a shearing force or bending, and so the O-rings are less susceptible to wearing.

According to the foregoing embodiment, as constructed from a metal foot 23 and rubber O-rings 25, each foot assembly 22 can effectively counteract vibration occurring in the axial direction of the foot 23 and reduce vertical vibration of the base 12 while facilitating a smooth orbital motion of the base 12. As described previously, the arrangement also reduces the effects of heat generated by the operation of the sander 1 as well as wear of the O-rings 25, thus enhancing the durability of the foot assemblies 22.

Furthermore, the O-rings 25 provide desired elasticity at a relatively low cost, thus contributing to reduction in the overall manufacturing cost of the finishing sander 1.

It should be noted that the manner or structure of supporting each foot's reduced diameter section 24 in the recessed seat 26 is not limited to that described in the foregoing. For example, a ring having a square or rectangular cross-section or a plurality of balls may replace the O-ring 25. Alternatively, the reduced diameter sections 24 may be omitted so that both ends of each foot are supported by rubber elements having a general shape of a cup with no handle. As a still another example, rubber balls or a flat plate may be interposed between each bottom surface of one of the foot seats and the foot end without the reduced portions. As long as each foot can be elastically supported in the axial direction, any other suitable structure may be employed. Moreover, different supporting structures may be used for the upper and lower ends of each foot. For example, while the lower end of the foot, which has a greater momentum than the upper end of the foot, may be supported by the structure of the embodiment (i.e., a reduced diameter section in an O-ring), balls or a flat plate may be employed for the upper end of the foot.

Although any desired metal other than aluminum may be used as the material of the feet, aluminum is most preferred due to its lightness, hardness, and heat radiation.

Equivalents

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

Having described the invention, what is claimed as new and desired to be secured by letters patent is:

1. A sander comprising:

a main body containing a motor;

a base provided below the main body, the based being driven by the motor to perform an orbital motion;

a plurality of foot seats provided in the main body and the base; and at least one foot assembly disposed between the main body and the base, each of the at least one foot assembly including a metal foot having upper and lower end portions and an axis and each of the at least one foot assembly further including elastic bodies adapted to support the end portions in the foot seats in the axial direction of the foot.

2. A sander in accordance with claim 1, wherein the number of the foot assembly is four, each foot including reduced diameter sections provided at the upper and lower end portions thereof, and wherein the elastic bodies include O-rings fitted around the reduced diameter sections in the foot seats.

3. A sander in accordance with claim 2, wherein each O-ring has a circular cross-section, and wherein each foot has a cylindrical shape and each reduced diameter section also has a cylindrical shape which has a smaller diameter than the diameter of the remainder of the foot and which is coaxially formed on one of the upper and lower end portions of the foot.

4. A sander in accordance with claim 2, wherein each O-ring has a greater axial dimension than that of each reduced diameter section, such that a free end of each reduced diameter section does not project from an outermost end of the O-ring.

5. A sander in accordance with claim 2, wherein each foot seat includes a recess sized and dimensioned for snugly accommodating an O-ring and a reduced diameter section.

6. A sander in accordance with claim 2, wherein each O-ring is coaxially fitted around the reduced diameter portion in the foot seat, such that, when the sander is in use, the O-rings are subjected to compression but not to either shearing or bending.

7. A sander in accordance with claim 1, wherein each foot is made of aluminum.

* * * * *